US007281392B2

(12) United States Patent
Liu

(10) Patent No.: US 7,281,392 B2
(45) Date of Patent: Oct. 16, 2007

(54) BEVERAGE-COOLING DEVICE

(75) Inventor: Feng Liu, Taipei (TW)

(73) Assignee: Circle & Oblong International Co. Ltd., Taipei (TW)

( * ) Notice: Subject to any disclaimer, the term of this patent is extended or adjusted under 35 U.S.C. 154(b) by 143 days.

(21) Appl. No.: 11/202,559

(22) Filed: Aug. 12, 2005

(65) Prior Publication Data

US 2007/0033963 A1 Feb. 15, 2007

(51) Int. Cl.
*F25D 3/08* (2006.01)

(52) U.S. Cl. ..... 62/457.2; 222/146.6

(58) Field of Classification Search ..... 62/389, 62/201, 339, 391, 395, 398, 399, 457.2, 457.3, 62/457.4, 457.5; 222/146.6
See application file for complete search history.

(56) References Cited

U.S. PATENT DOCUMENTS 3,191,402 A * 6/1965 Baker ..... 62/399
3,225,965 A * 12/1965 Jacobs et al. ..... 222/129.1
3,231,143 A * 1/1966 Cserny ..... 222/183
3,824,801 A * 7/1974 Laudato, Jr. ..... 62/201
3,865,276 A * 2/1975 Thompson ..... 222/146.6
3,923,662 A * 12/1975 O'Brien ..... 210/251
3,933,275 A * 1/1976 Metzner et al. ..... 222/131
4,342,202 A * 8/1982 Knutson ..... 62/243
4,518,104 A * 5/1985 Iannelli et al. ..... 222/146.6
4,708,938 A * 11/1987 Hickinbotham ..... 435/297.2
5,121,612 A * 6/1992 Guay et al. ..... 62/390
6,105,825 A * 8/2000 Gomi et al. ..... 222/146.6

FOREIGN PATENT DOCUMENTS

JP 11-304323 A * 11/1999

* cited by examiner

*Primary Examiner*—Mohammad M. Ali
(74) *Attorney, Agent, or Firm*—Apex Juris, pllc; Tracy M. Heims

(57) ABSTRACT

A beverage-cooling device includes a refrigeration unit, a position unit and a switch unit. The refrigeration unit has a housing with a cavity formed therein and a tube disposed inside the cavity. The tube has an inlet and an outlet both secured to the housing, and the inlet is higher than the outlet. The position unit has a base member connecting to the refrigeration unit, a control member pivoted to the base member, and a securing member adjustably assembled onto the control member. The base member has a passage formed therein to communicate with the inlet of the tube. The control member has a through hole communicating with the passage. The securing member orientates a bottle mouth of a bottle to the control member, wherein the bottle mouth communicates with the through hole. The switch unit is secured to the refrigeration unit and connected with the outlet of the tube.

10 Claims, 6 Drawing Sheets

BEVERAGE-COOLING DEVICE

BACKGROUND OF THE INVENTION

1. Field of the Invention

The present invention relates to a beverage-cooling device, and particularly relates to a beverage-cooling device that can be filled with a beverage and further cold storage.

2. Background of the Invention

Cold beverages quench people's thirst and make them feel better and revitalized, especially in hot weather.

Generally speaking, cold beverages should be placed in a refrigerator to maintain their temperature. However, a refrigerator needs additional supplies, such as freon and external power source, to maintain a cold environment therein. In addition, the refrigerator must be adapted for its power source and its application is limited. And without a refrigerator, it is difficult to chill a beverage or maintain its cold temperature for extended periods of time.

Taking beer as an example, the colder a beer is, the better its taste. But if the beer is consumed over a long time period, the beer's temperature will gradually increase and the taste will become less pleasant. If ice cubes are added to lower the temperature of the beer, the beer will become diluted, spoiling the flavor and lessening the drinker's enjoyment of their beverage.

SUMMARY OF INVENTION

A beverage-cooling device is provided that does not require an additional power source.

The beverage-cooling device is provided for lowering the temperature of a beverage without limiting the place and time of its consumption.

Furthermore, because the beverage is cooled by a method that does not dilute the original flavor, the concentration and therefore taste of the beverage is maintained.

A beverage-cooling device includes a refrigeration unit, a position unit, and a switch unit. The refrigeration unit has a housing and a tube. The housing has a cavity formed therein, and the tube is disposed inside the cavity, the tube has an inlet and an outlet both secured to the housing, and the inlet is higher than the outlet. The position unit has a base member, a control member and a securing member. The base member connects to the refrigeration unit and has a passage formed therein to communicate with the inlet of the tube. The control member is pivoted to the base member and has a through hole that communicates with the passage optionally. The securing member is adjustably assembled to the control member and orientated to a mouth of a bottle to the control member, wherein the bottle mouth communicates with the through hole. The switch unit is secured to the refrigeration unit and connects with the outlet of the tube.

Because the securing member orientates the bottle and the through hole of the control member can communicate with the passage of the base member, the beverage inside the bottle can easily flow into the tube of the refrigeration unit to lower the temperature of the beverage. Therefore, the temperature of the beverage can be lowered without the need for an additional power source, allowing beverages to served cold regardless of place or time.

Furthermore, the beverage-cooling device includes an air-pumping unit to pump air into the bottle for good taste/improving the taste of the beverage/ensuring the beverage retains its flavor.

To provide a further understanding of the invention, the following detailed description illustrates embodiments and examples of the invention. Examples of the more important features of the invention have thus been summarized rather broadly in order that the detailed description thereof that follows may be better understood, and in order that the contributions to the art may be appreciated. There are, of course, additional features of the invention that will be described hereinafter which will form the subject of the claims appended hereto.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF THE EMBODIMENTS

Figure 1:
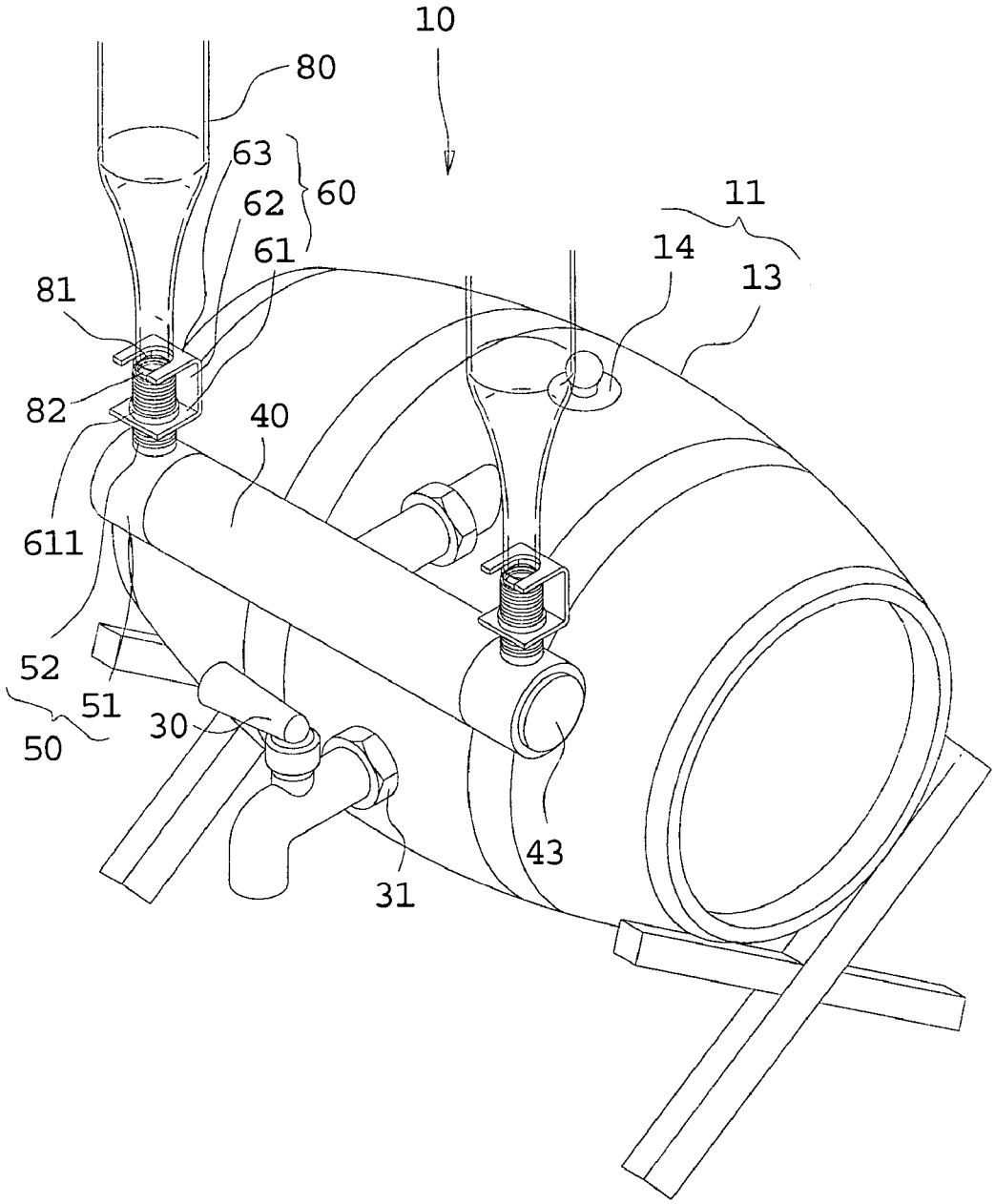
FIG. 1 is a perspective view of a first embodiment of a beverage-cooling device according to the present invention.
Figure 2:
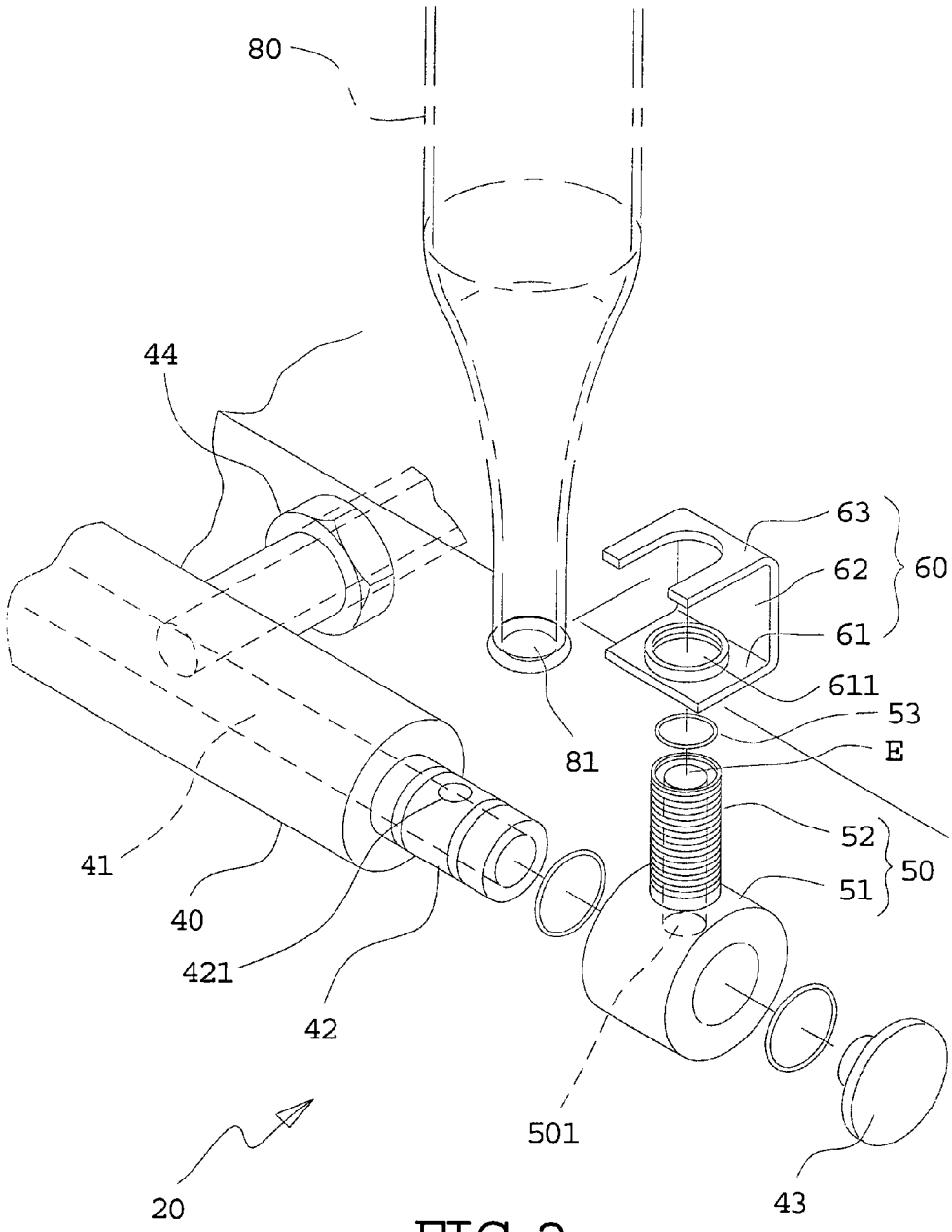
FIG. 2 is an enlarged decomposition view of the first embodiment of the beverage-cooling device according to the present invention.
Figure 3:
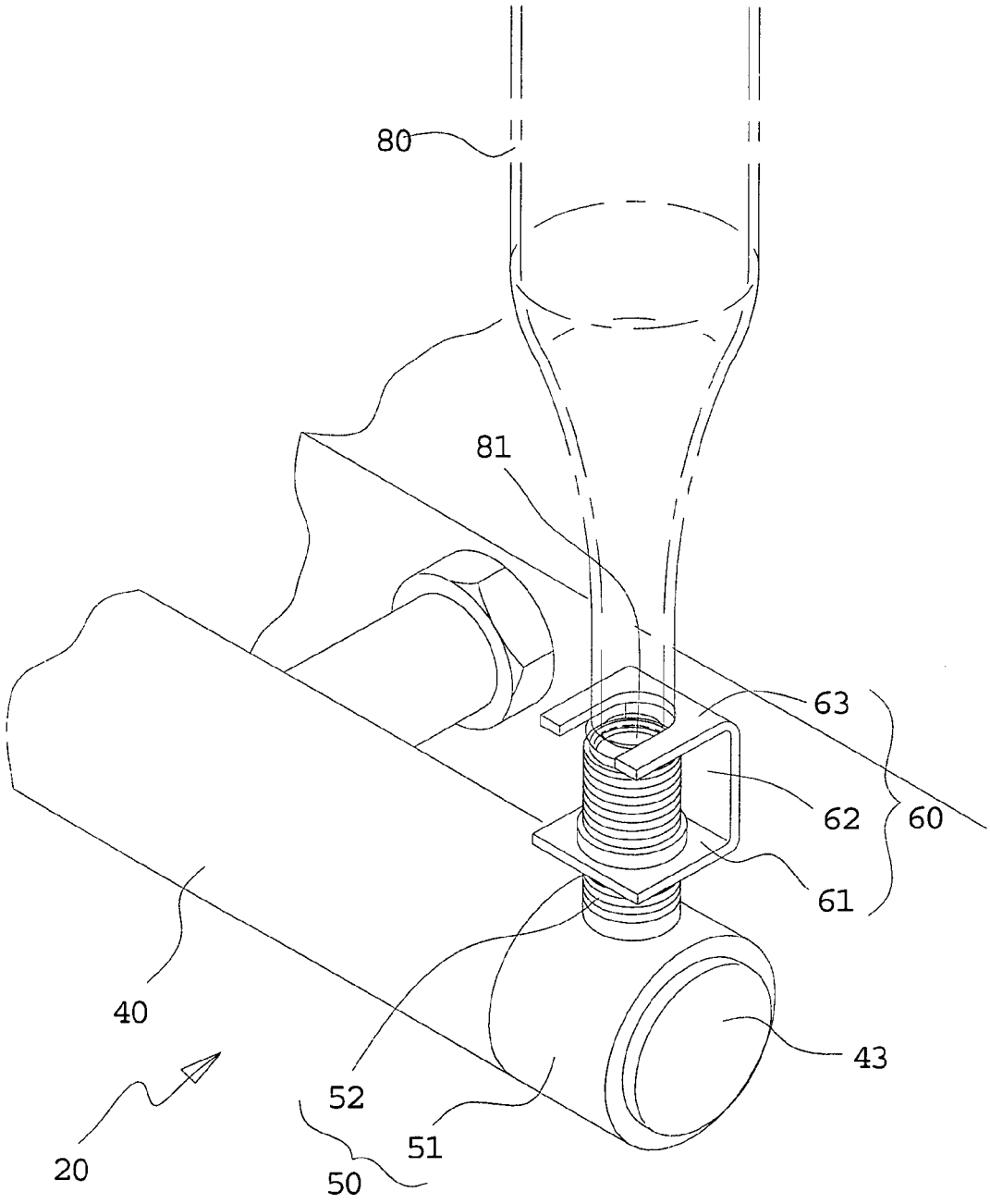
FIG. 3 is an enlarged composition view of the first embodiment of the beverage-cooling device according to the present invention.
Figure 4:
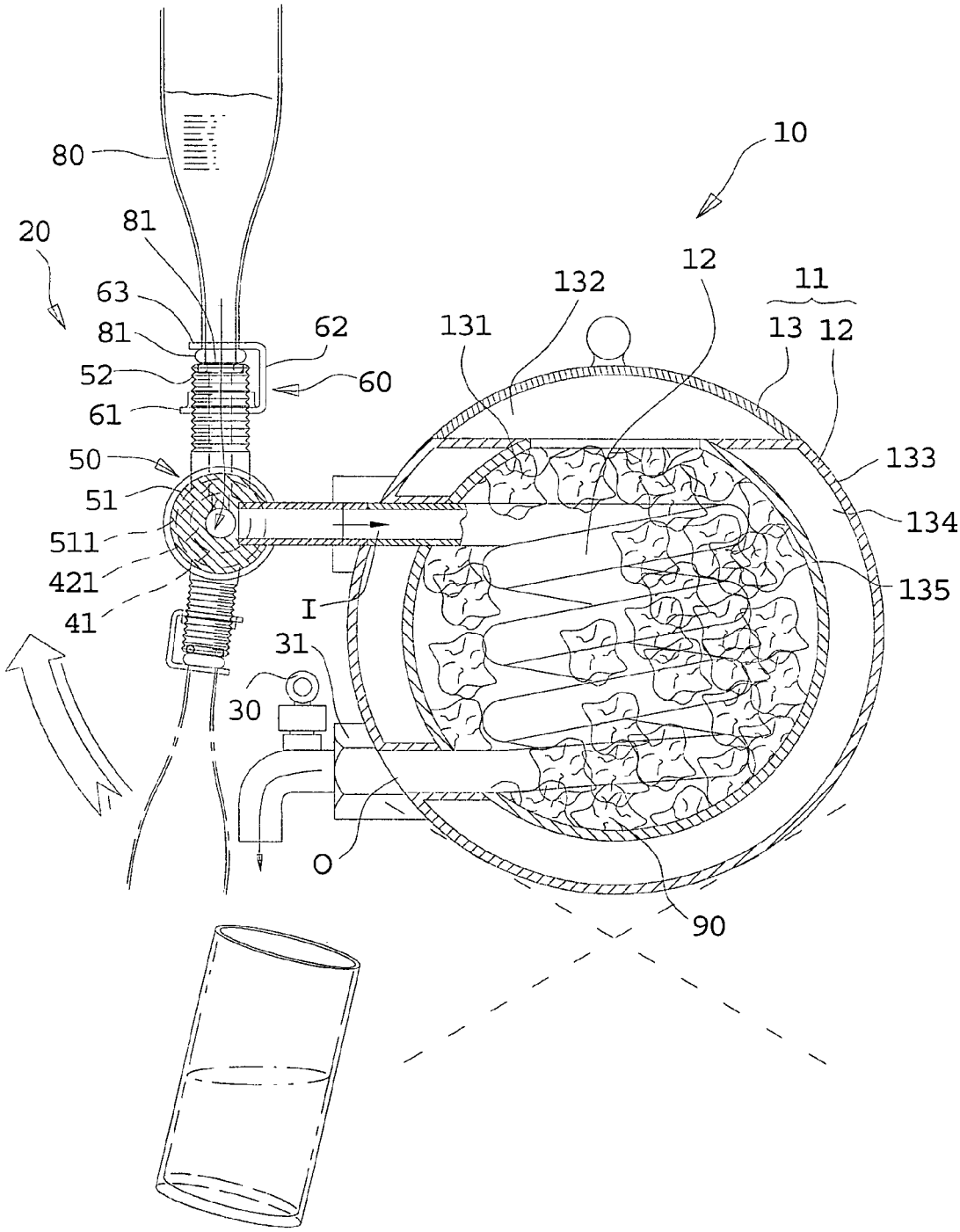
FIG. 4 is a perspective view of an application of the first embodiment of the beverage-cooling device according to the present invention.

Referring to FIGS. 1 to 3, a first embodiment of a beverage-cooling device according to the present invention includes a refrigeration unit 10, a position unit 20 and a switch unit 30.

The refrigeration unit 10 has a housing 11 and a tube 12. The housing 11 has a main body 13 and a cover 14. The main body 13 has an opening 131, and a cavity 132 formed in the main body 13. A cooling source 90 is disposed inside the cavity 132, such as ice cubes. The cover 14 encloses the opening 131 of the main body 13. In this embodiment, the main body 13 has an exterior layer 133, a middle layer 134 and an interior layer 135. The exterior body 123 is a layer made of a strong, durable product, such as reinforced plastic. The middle layer 134 is a heat insulation layer, such as Styrofoam. The interior layer 135 is a cooling layer, such as an aluminum material. Therefore, the structure of the main body 13 is firm and solid in order to maintain a low temperature. There are no limitations of the layers and the materials on the structure of main body 13. The tube 12 should be made of materials with excellent conductivity. The tube 12 is disposed inside the cavity 132. In this embodiment, the tube 12 is designed with a spiral shape to increase the surface area thereof. The tube 12 has an inlet "I" and an outlet "O" both secured to the housing 11, and the inlet "I" is higher than the outlet "O", so that the beverage inside the tube 12 can flow downwardly naturally.

The position unit 20 has a base member 40, a control member 50 and a securing member 60. The base member 40 connects to the refrigeration unit 10 and has a passage 41 formed therein to communicate with the inlet "I" of the tube 12. The base member 40 has a shaft 42 that has a flowing hole 421 communicating with the passage 41. The flowing hole 421 is arranged with an angle ranging from 0 degree to 180 degrees. In this embodiment, the angle should be 90 degrees. The shaft 42 of the base member 40 is fitted to a sealing circle at the flowing hole 421 in order to prevent any overflow. The base member 40 includes a plug 43. The control member 50 includes a sleeve portion 51 pivoted to the shaft 42 of the base member 40, and a screwed tube portion 52 connecting the sleeve portion 51. The plug 43 orientates to the shaft 42 of the base member 40 and blocks the sleeve portion 51. The sleeve portion 51 of the control member 50 includes a though hole 511 that communicates with the passage optionally 40. The through hole 501 penetrates through the screwed tube portion 52. The sealing circle 53 is embedded at an exit "E" of the screwed tube portion 52 in order to prevent overflow. The securing member 60 is adjustably assembled to the control member 50 and orientated with a bottle mouth 81 of a bottle 80 to the control member 50, wherein the bottle mouth 81 communicates with the through hole 501. In this embodiment, the securing member 60 is U-shaped and includes a screw-mated portion 61, a groundwork portion 62 and a hook-mated portion 63 made integrally in one piece. The screw-mated portion 61 has a screw hole 611 mating with the screwed tube portion 52 of the control member 500. The hook-mated portion 63 has a cutout 631 which mates with a flange of the bottle mouth 81 in order to orientate the bottle mouth 81 to the exit "E" of the screwed tube 51 of the control member 50, and the bottle mouth 81 communicates with the through hole 501 via the exit "E". The switch member 3 is secured to the refrigeration unit 10 via the securing member 31 and communicates with the outlet "O" of the tube 12. The switch member 3 can be any type of faucet.

With respect to FIGS. 1 to 4, the cooling source 90, such as ice cubes, is disposed inside the opening 131 of the housing 11 of the refrigeration unit 10. The cover 14 encloses the opening 131. The structure of the housing 11 guarantees a low temperature is maintained due to the ice cubes. The bottle 80 is secured to the position unit 20. The cutout 631 of the hook-mated portion 63 of the securing member 60 mates with the flange 81 of the bottle mouth 81 of the bottle 80. The securing member 60 can be rotated to lift the hook-mated portion 63 so that the securing member 60 is disposed at the exit "E" of the screwed tube portion 52 of the control member 50. Thus, the bottle mouth 81 can communicate with the through hole 501 of the sleeve portion 51 via the exit "E". The bottle 80 is further pushed and lifted to rotate the control member 50, so that the through hole 501 aligns with the flowing hole 421 of the base member 40. The beverage in the bottle 80 flows into the passage 41 of the base member 40 by passing the through hole 501 and the flowing hole 421. The beverage further passes through the tube 12, is cooled immediately, and flows out of the switch member 3. Any part of the beverage that remains inside the tube 12 will be cooled. The base member 40 or the base member 11 can be further assembled with a relief valve (not shown) so that the beverage will flow out of the switch member 3 smoothly. The housing 11 or the base member 40 can be further assembled with a clamping apparatus (not shown) for holding the bottle 80.

Figure 5:
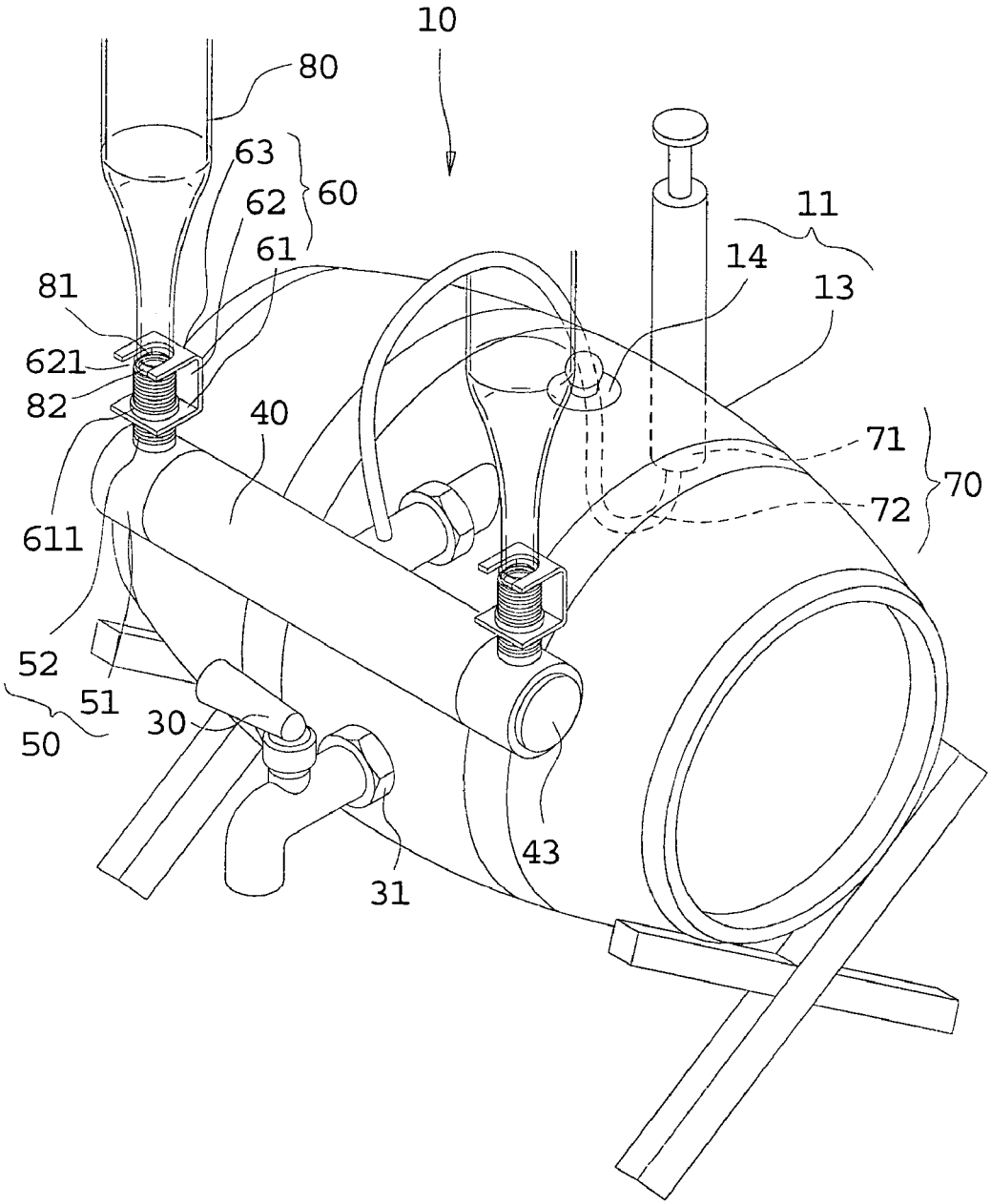
FIG. 5 is a perspective view of a second embodiment of the beverage-cooling device according to the present invention.
Figure 6:
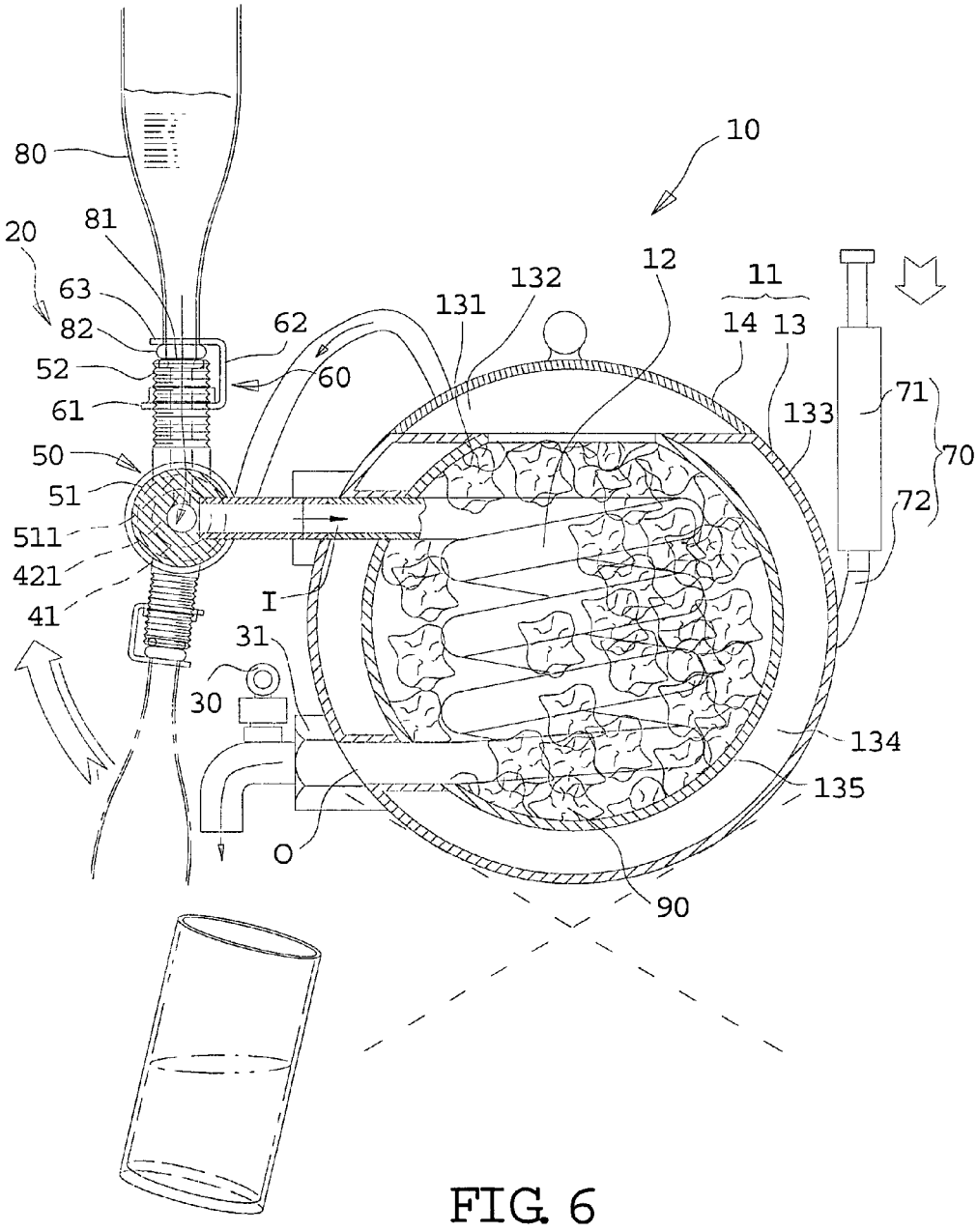
FIG. 6 is a perspective view of an application of the second embodiment of the beverage-cooling device according to the present invention.

FIGS. 5 and 6 show a second embodiment of the beverage-cooling device according to the present invention. An air-pumping unit 70 communicates with the passage 41 of the base member 40 of the position unit 20. The air-pumping unit 70 includes an pump 71 and piping 72. Two ends of the piping 72 connect to the pump 71 and the base member 40 of the position unit 20 respectively. This embodiment is particularly adapted for beer. The bottle 80 can be lifted to rotate the control member 50, and the pump 71 is used to pump air into the beverage. The air passes through the piping 72 to the passage 41 of the base member 40 and further into the bottle 80 via the flowing hole 421 and the through hole 501. Thereby the air mixes up with the beer to generate gas to thrust the beer into the tube 12. Therefore, the temperature of the beer is lowered, the air mixed into the beer makes the beer sweet, refreshing and the bubbles created by the infused the air gives the beer a desirable amount of bubbles or carbon dioxide.

The following are the advantages of the beverage-cooling device according to the present invention:

1. The securing member orientates the bottle and the through hole so that it can communicate with the passage of the base member. This allows the beverage inside the bottle to easily flow into the tube of the refrigeration unit without the need for an additional power source. As such, use of the present invention is not limited by location or time. Furthermore, because the beverage is not diluted by cooling agents, such as ice cubes, the original concentration and flavor of the beverage is retained.
2. Furthermore, the air-pumping unit pumps air into the beer to make the beer tasty and refreshing.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A beverage-cooling device, comprising:

a refrigeration unit having a housing and a tube, the housing having a cavity formed therein and the tube disposed inside the cavity, the tube having an inlet and an outlet both secured to the housing, and the inlet being higher than the outlet;

a position unit including a base member, a control member and a securing member, the base member connected to the refrigeration unit and having a passage formed therein to communicate with the inlet of the tube, the control member pivoted to the base member and having a through hole that communicates with the passage, and the securing member adjustably assembled onto the control member and orientated to a bottle mouth of a bottle to the control member, wherein the bottle mouth communicates with the through hole; and a switch unit secured to the refrigeration unit and connected to the outlet of the tube.

2. The beverage-cooling device as claimed in claim 1, further including a cooling source arranged in the cavity of the housing of the refrigeration unit.

3. The beverage-cooling device as claimed in claim 1, wherein the housing includes a main body and a cover, the main body has an opening, the cavity is formed in the main body, and the cover encloses the opening of the main body.

4. The beverage-cooling device as claimed in claim 3, wherein the main body has an exterior layer, a middle layer and an interior layer, the exterior body is a layer made of a strong, durable product, the middle layer is a heat insulation layer, and the interior layer is a cooling layer.

5. The beverage-cooling device as claimed in claim 1, wherein the base member includes a shaft, which has a flowing hole communicating with the passage, the flowing hole is arranged with an angle ranging from 0 degree to 180 degrees.

6. The beverage-cooling device as claimed in claim 5, wherein the base member includes a plug, the control member includes a sleeve portion pivoted to the shaft of the base member, the through hole is arranged on the sleeve portion, and the plug is orientated to the shaft of the base member and blocks the sleeve portion.

7. The beverage-cooling device as claimed in claim 5, wherein the control member includes a sleeve portion pivoted to the shaft of the base member and a screwed tube portion connecting the sleeve portion, the through hole is arranged on the sleeve portion and penetrates through the screwed tube portion, and the securing member assembles together with the screwed tube portion.

8. The beverage-cooling device as claimed in claim 7, wherein the securing member is U-shaped and includes a screw-mated portion, a groundwork portion and a hook-mated portion made integrally in one piece, the screw-mated portion has a screw hole mating with the screwed tube portion of the control member, the hook-mated portion has a cutout mating with a flange of the bottle mouth in order to orientate the bottle mouth to an exit of the screwed tube of the control member, and the bottle mouth communicates with the through hole via the exit.

9. The beverage-cooling device as claimed in claim 8, wherein the screwed tube of the control member has a sealing circle embedded at the exit thereof, the shaft of the base member is fitted to the sealing circle.

10. The beverage-cooling device as claimed in claim 1, further including an air-pumping unit communicating with the passage of the base member of the position unit.

* * * * *